US011140992B1

(12) United States Patent
Schmitz

(10) Patent No.: US 11,140,992 B1
(45) Date of Patent: Oct. 12, 2021

(54) COMFORT AID APPARATUS FOR USE ON A COUCH

(71) Applicant: Leo IP LLC, Naperville, IL (US)

(72) Inventor: Nancy Schmitz, Naperville, IL (US)

( * ) Notice: Subject to any disclaimer, the term of this patent is extended or adjusted under 35 U.S.C. 154(b) by 186 days.

(21) Appl. No.: 16/501,723

(22) Filed: May 28, 2019

Related U.S. Application Data

(60) Provisional application No. 62/762,986, filed on May 29, 2018.

(51) Int. Cl.
*A47C 17/86* (2006.01)
*A47C 27/22* (2006.01)
*A47C 27/14* (2006.01)

(52) U.S. Cl.
CPC ..... *A47C 17/86* (2013.01); *A47C 27/148* (2013.01); *A47C 27/22* (2013.01)

(58) Field of Classification Search
CPC ..... A47G 9/02; A47G 9/08; A47G 9/0223; A47C 31/11; A47C 31/00; A47C 17/86; A47C 27/148; A47C 27/22; B32B 5/024; B32B 5/245
See application file for complete search history.

(56) References Cited

U.S. PATENT DOCUMENTS 3,716,875 A * 2/1973 Fehr ..... A47C 27/16 5/655.7
5,548,858 A 8/1996 Shoa
7,243,385 B2 7/2007 Lampkins
7,874,028 B2 1/2011 Bradford
8,584,728 B2 11/2013 Ross
9,107,519 B2 * 8/2015 Clark ..... A47G 9/083
9,434,126 B1 * 9/2016 Williams ..... B32B 5/245
2008/0313870 A1 12/2008 Inman, II
2010/0089958 A1 * 4/2010 Flagel ..... A45C 9/00 224/576

(Continued)

FOREIGN PATENT DOCUMENTS

WO WO-2016041400 A1 * 3/2016 ..... A47C 27/15

OTHER PUBLICATIONS

Rubber Latex Products (Year: 2020).*

*Primary Examiner* — David R Hare
*Assistant Examiner* — Adam C Ortiz
(74) *Attorney, Agent, or Firm* — Mark E. Wiemelt

(57) ABSTRACT

A comfort aid apparatus used specifically for the top of the resting/laying area of a couch to provide a more comfortable rest for the user both physically and mentally. Two foam sheets are encased with a sustainable natural woven fiber textile. The first foam sheet is constructed of natural latex sustainably extracted from rubber trees. The second foam sheet is a natural plant coconut fiber with a bonding agent of Latex. The encased foam sheets are then covered with a removable zipper cover which is also made of a natural woven fiber textile. In addition to a more physically comfortable rest on the couch and significantly helping preserve the resiliency and integrity of the shape of the couch and extend the life expectancy of the couch, the apparatus provides a comfort aid mentally, by providing a protective barrier for the user significantly reducing exposure to environmental and manufactured toxins which are on the surface of, or emitting from, the couch, or germs and infections from others who have had previous physical contact with the couch.

2 Claims, 23 Drawing Sheets

(56) References Cited

U.S. PATENT DOCUMENTS

| | | | | |
|---|---|---|---|---|
| 2014/0259400 | A1* | 9/2014 | Stryker | A61G 7/057<br>5/421 |
| 2015/0123439 | A1* | 5/2015 | Jordan | A47C 7/425<br>297/228.1 |
| 2017/0283069 | A1* | 10/2017 | Hall | A47C 31/001 |

* cited by examiner

COMFORT AID APPARATUS FOR USE ON A COUCH

CROSS-REFERENCE TO RELATED APPLICATIONS

This application claims priority of U.S. Provisional Patent Application Ser. No. 62/762,986, filed on May 30, 2018, the entire contents of which are incorporated herein by reference.

BACKGROUND OF THE INVENTION

1. Field of the Invention

The invention generally relates to a comfort aid apparatus for use on a couch. More specifically, the invention relates to a comfort aid apparatus suitable for placement on the resting/laying area of a couch to provide a more comfortable rest for the user both physically and mentally, by providing a comfort aid apparatus that significantly helps preserve the resiliency and integrity of the shape of the couches and extends the life expectancy of the couches and providing a protective barrier for the user significantly reducing exposure to environmental and manufactured toxins which are on the surface of, or emitting from, the couch, or germs and infections from others who have had previous physical contact with the couch.

2. The Prior Art

There are a variety of prior art couch covers. However, prior art couch covers generally provide sheets made of cotton, flannel, silk, polyester, rayon, or a blend of the foregoing, e.g., cotton/polyester, without providing a sufficient protective barrier for the user from exposure to environmental and manufactured toxins which are on the surface of, or emitting from, the couch, or germs and infections from others who have had previous physical contact with the couch. In addition, prior art couch covers do not significantly help preserve the resiliency and integrity of the shape of the couches and extends the life expectancy of the couches. As a result, the user of the couches experiences decreasing comfort over time. By way of example, with prior art couches and couch covers, the cushions and foam inserts in the resting/laying areas of the couches generally break down and will shrink in size, as they lose their ability to return to their original dimensions. As this shrinkage occurs, the couches' foam/cushion inserts will no longer fill their covers as they once did. This is repeatedly displayed by an uneven, sagging, loose, or wrinkling in the couch cushions and resting/laying areas. The open-cell foam which is used in the cushions for most couch resting/laying areas will, over time, have a breakdown in structure resulting in the foam struts breaking down and losing their ability to comfortably bear weight because of shrinkage in their original dimensions. There is no satisfactory known solution to these problems provided in the prior art.

It is therefore an objective of the invention to provide a comfort aid apparatus used specifically for the top of the resting/laying area of a couch to provide a more comfortable rest for the user both physically and mentally, by providing a comfort aid apparatus that significantly helps preserve the resiliency and integrity of the shape of the couches and extends the use and life expectancy of the couches and providing a protective barrier for the user significantly reducing exposure to environmental and manufactured toxins which are on the surface of, or emitting from, the couch, or germs and infections from others who have had previous physical contact with the couch.

SUMMARY OF THE INVENTION

An object of the invention is to provide a comfort aid apparatus for use on a couch.

Another object of the invention is to provide a comfort aid apparatus used specifically for the top of the resting/laying area of a couch to provide a more comfortable rest for the user both physically and mentally, by providing a protective barrier for the user significantly reducing exposure to environmental and manufactured toxins which are on the surface of, or emitting from, the couch, or germs and infections from others who have had previous physical contact with the couch.

Yet another object of the invention is to provide a comfort aid apparatus which extends the use and life expectancy of a couch.

Still another object of the invention is to provide a comfort aid apparatus that significantly helps preserve the resiliency and integrity of the shape of the couch.

These together with other objects of the present invention, along with the various features of novelty which characterize the present invention, are contained in this disclosure. For a better understanding of the present invention, its operating advantages and the specific objects attained by its uses, reference should be had to the accompanying drawings and descriptive matter in which there is illustrated a preferred embodiment of the present invention and alternative embodiments.

In a preferred embodiment, a comfort aid apparatus for use with a couch is provided including a generally rectangular block first foam member and a generally rectangular block second foam member. The first foam member is made from natural latex sustainably extracted from rubber trees. The second foam member is made from a natural plant coconut fiber with a bonding agent of latex. The first foam member and the second foam member are stacked together and encased with a sustainable natural woven fiber textile. The encased foam members are then enclosed in a removable zipper cover which is also made of a sustainable natural woven fiber textile, forming a comfort aid apparatus that significantly helps preserve the resiliency and integrity of the shape of the couches and extends the use and life expectancy of the couches and a protective barrier for the user significantly reducing exposure to environmental and manufactured toxins which are on the surface of, or emitting from, the couch, or germs and infections from others who have had previous physical contact with the couch There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention.

Before explaining a preferred embodiment and alternative embodiments of the present invention in detail, it is to be understood that the present invention is not limited in its application to the details of construction, to the arrangements of the components set forth in the following description or illustrated in the drawings, or to the methods described therein. The present invention is capable of other embodiments and of being practiced and carried out in various ways. Also, it is to be understood that the phraseology and terminology employed herein are for the purpose of description and should not be regarded as limiting. For example, the term couch is intended to encompass equivalent structures, such as a sofa, settee, chesterfield, or the like.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the present invention in any way.

DETAILED DESCRIPTION OF A PREFERRED EMBODIMENT

Figure 1:
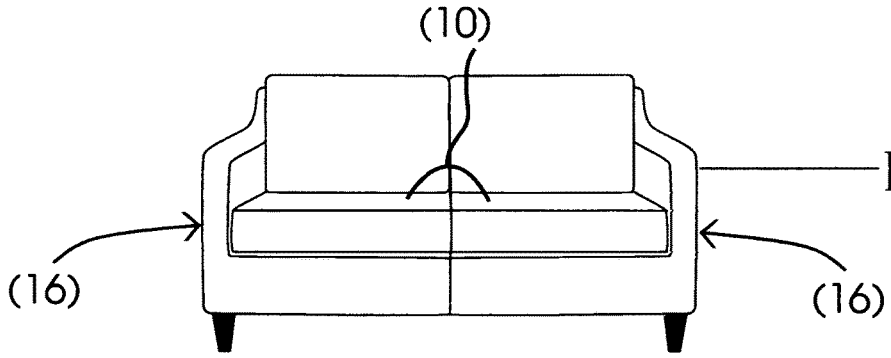
FIG. 1 is a front view of a conventional couch generally intended for two users.

While this present invention is susceptible of embodiments in many different forms, there are shown in the drawings and will be described in detail herein, a preferred embodiment, with like parts designated by like reference numerals and with the understanding that the present disclosure is to be considered as an exemplification of the principles of the present invention, and is not intended to limit the claims to a illustrated preferred embodiment.

Figure 2:
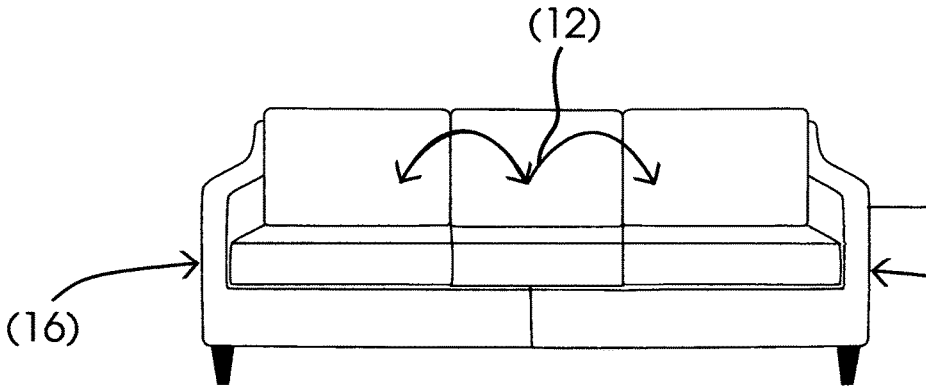
FIG. 2 is a front view of a conventional couch generally intended for three users.
Figure 3:
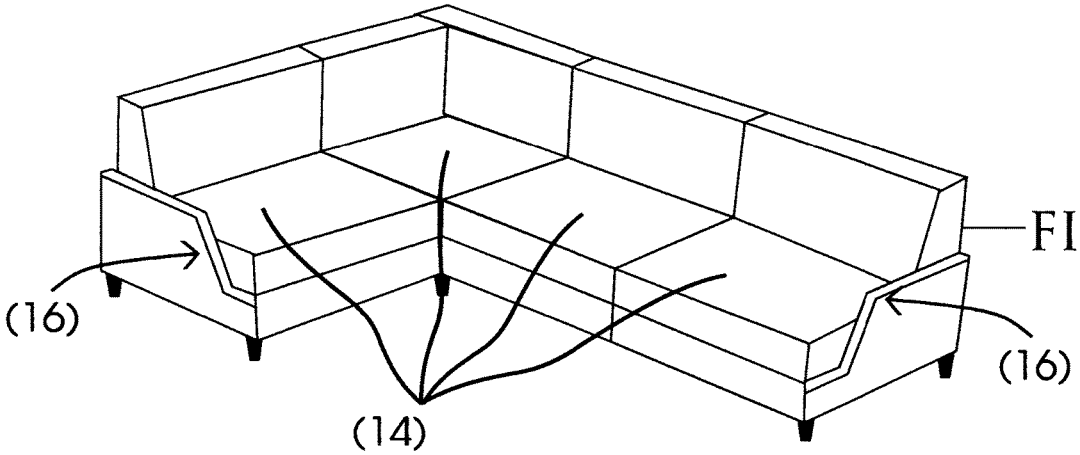
FIG. 3 is a front view of a conventional sectional couch.

Referring now to FIGS. 1-3, conventional couches 10, 12 & 14 having ends 16 are shown.

Figure 4:
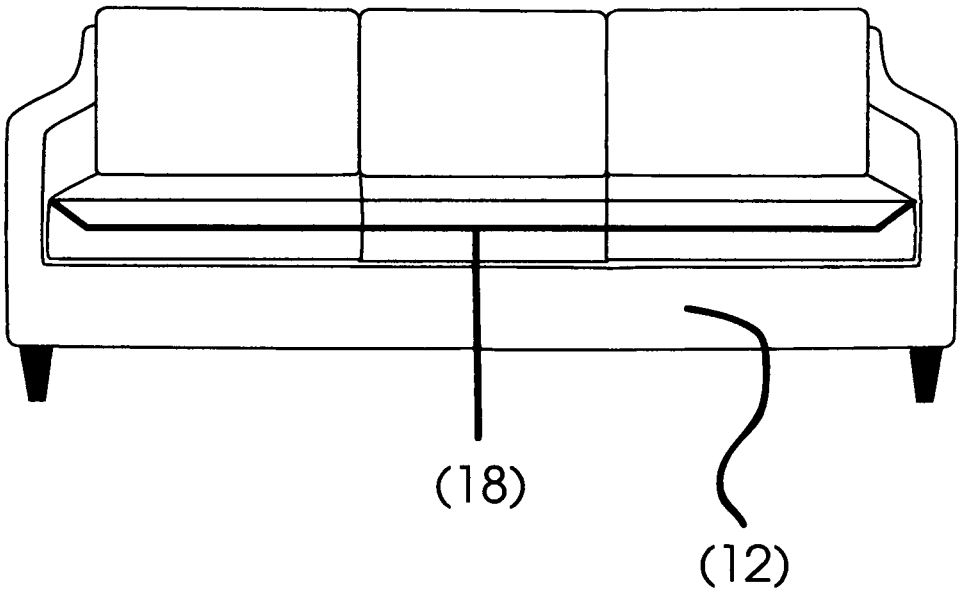
FIG. 4 is a front view of a couch illustrating the resting/laying area of a conventional couch.

Referring now to FIG. 4, a resting/laying area 18 is defined generally between ends 16 of couch 12 and generally overlaying the couch cushions.

Figure 5:
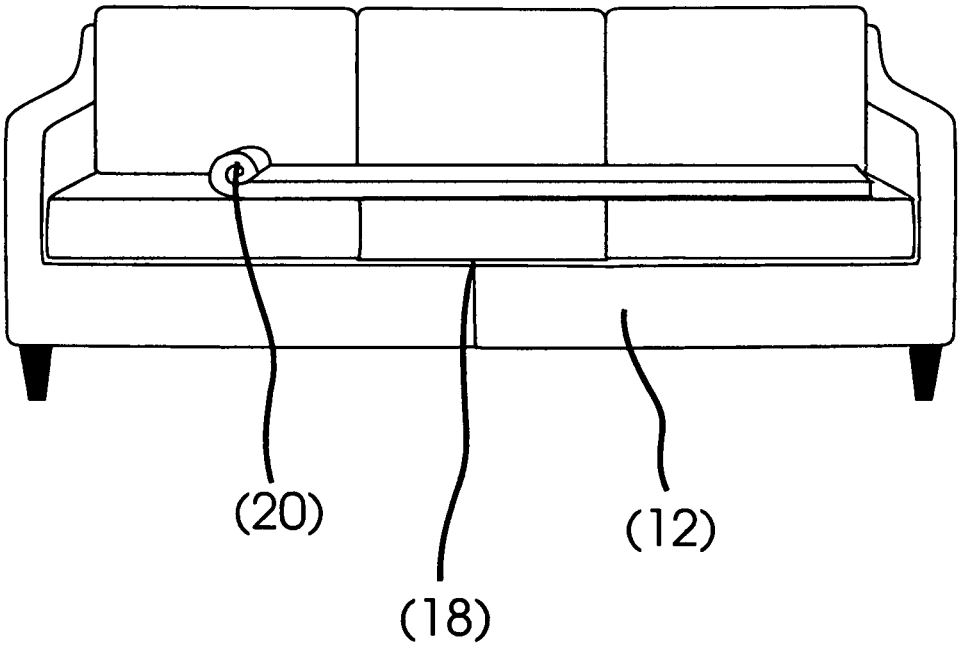
FIG. 5 is a front view of a preferred embodiment of the comfort aid apparatus partially rolled onto the resting/laying area of a conventional couch.

Referring now to FIG. 5, a preferred embodiment of the comfort aid apparatus 20 partially rolled onto the resting/laying area 18 of a conventional couch 12 is shown. In the preferred embodiment, the comfort aid apparatus 20 is a generally rectangular block which measures approximately 24 inches by approximately 70 inches by approximately 1.5 inch thickness, although it should be readily understood by those skilled in the art that the comfort aid apparatus 20 may be constructed of alternate shapes without departing from the scope and spirit of the invention. It should also be readily understood by those skilled in the art that the comfort aid apparatus 20 may be any size suitable to substantially overlay the resting/laying area 18 of any conventional couch, or at least that portion of a couch generally necessary to contain a user thereon.

Figure 6:
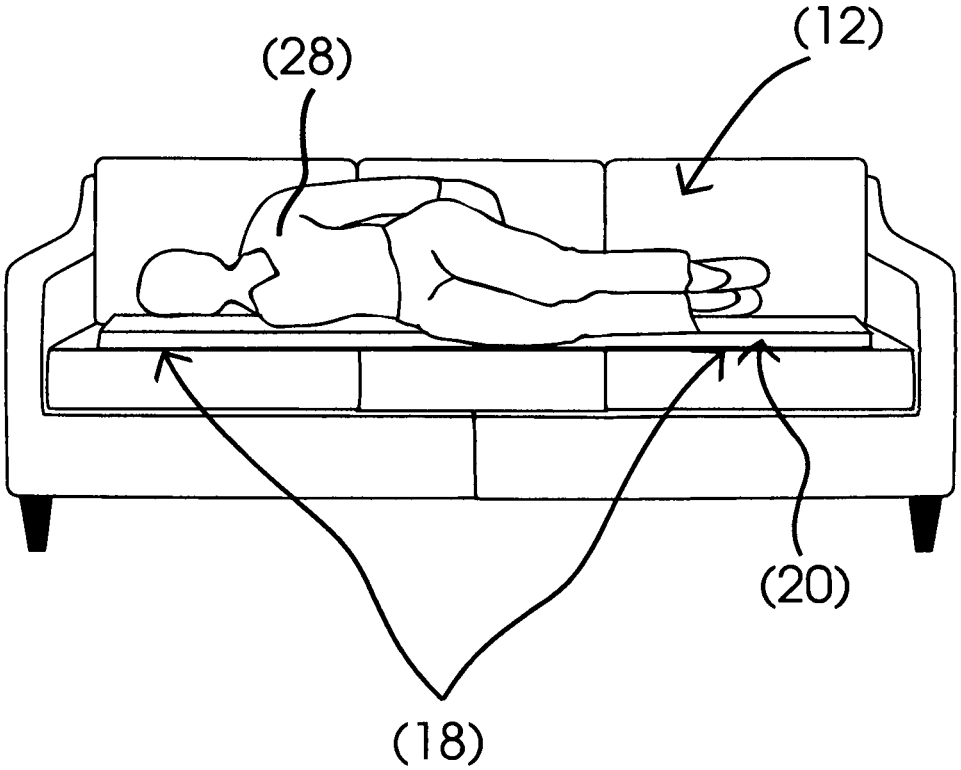
FIG. 6 is a front view of a preferred embodiment of the comfort aid apparatus rolled onto the resting/laying area of a conventional couch illustrating a user lying on the comfort aid apparatus.

Referring now to FIG. 6, a preferred embodiment of the comfort aid apparatus 20 rolled onto the resting/laying area 18 of a conventional couch 12 showing a user 28 lying on the comfort aid apparatus 20.

Figure 7:
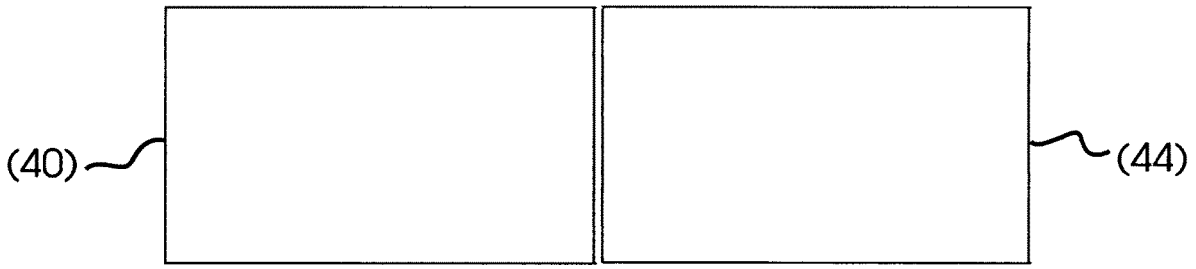
FIG. 7 is a top view of a first foam member and a second foam member of a preferred embodiment of the comfort aid apparatus.

Referring now to FIG. 7, a first foam member 40 and a second foam member 44 of a preferred embodiment of the comfort aid apparatus 20 are shown.

Figure 8:
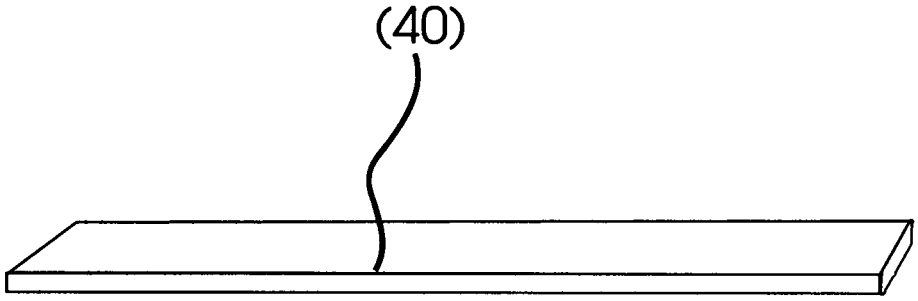
FIG. 8 is a perspective view of a first foam member of a preferred embodiment of the comfort aid apparatus.

Referring now to FIG. 8, the first foam member 40 of a preferred embodiment of the comfort aid apparatus 20 is shown. In the preferred embodiment, the first foam member 40 is constructed of natural latex extracted from rubber trees, although it should be readily understood by those skilled in the art that the first foam member 40 may be constructed of alternate materials without departing from the scope and spirit of the invention. In the preferred embodiment, the first foam member 40 is a generally rectangular block which measures approximately 24 inches by approximately 70 inches by approximately 1 to 2 inch thickness, although it should be readily understood by those skilled in the art that the first foam member 40 may be constructed of alternate shapes without departing from the scope and spirit of the invention. It should also be readily understood by those skilled in the art that the first foam member 40 may be any size suitable to substantially overlay the resting/laying area 18 of any conventional couch, or at least that portion of a couch generally necessary to contain a user thereon.

Figure 9:
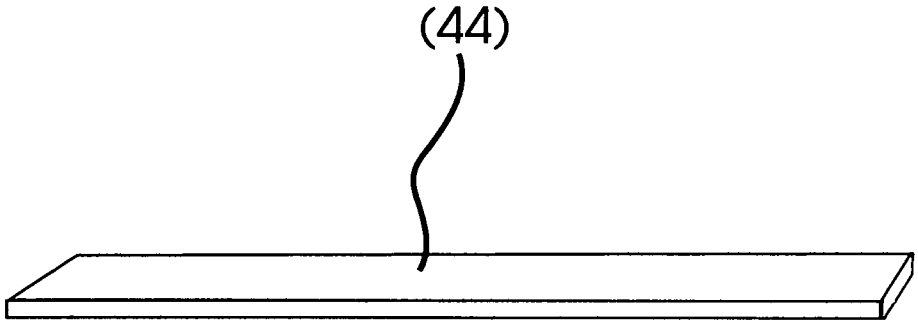
FIG. 9 is a perspective view of a second foam member of a preferred embodiment of the comfort aid apparatus.

Referring now to FIG. 9, the second foam member 44 of a preferred embodiment of the comfort aid apparatus 20 is shown. In the preferred embodiment, the second foam member 44 is constructed of a combination of coconut fiber with a bonding agent of latex which is of a higher density and firmness than the first foam member. In the preferred embodiment, is a generally rectangular block which measures approximately 24 inches by approximately 70 inches by approximately 1 to 2 inch thickness, although it should be readily understood by those skilled in the art that the second foam member 44 may be constructed of alternate shapes without departing from the scope and spirit of the invention. It should also be readily understood by those skilled in the art that the second foam member 44 may be any size suitable to substantially overlay the resting/laying area 18 of any conventional couch, or at least that portion of a couch generally necessary to contain a user thereon.

Figure 10:
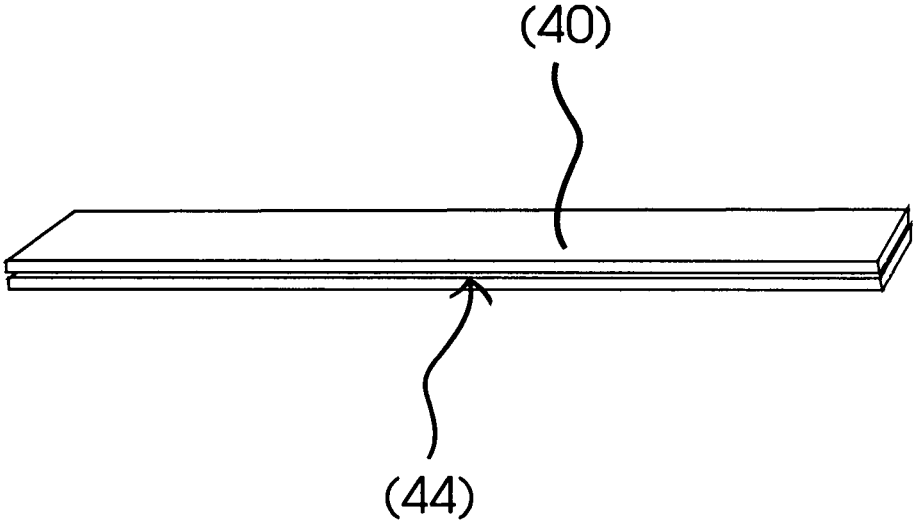
FIG. 10 is a perspective view of a first foam member stacked on top of a second foam member of a preferred embodiment of the comfort aid apparatus.

Referring now to FIG. 10, the first foam member 40 of a preferred embodiment of the comfort aid apparatus 20 is stacked on top of the second foam member 44 during construction, although it should be readily understood by those skilled in the art that the second foam member 44 can be stacked on top of the first foam member 40, without departing from the scope and spirit of the invention.

Figure 11:
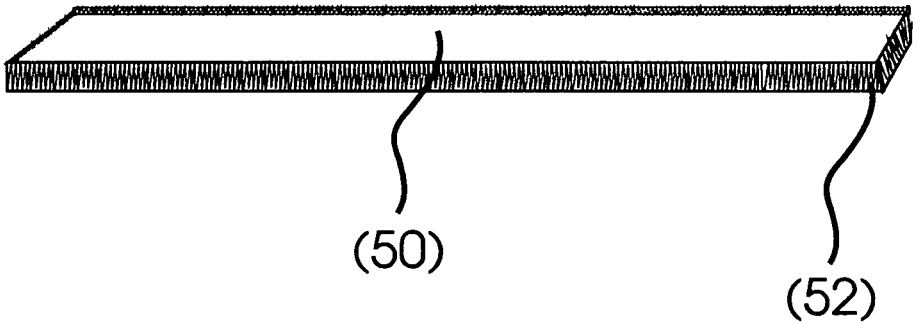
FIG. 11 is a perspective view of a sustainable natural fiber woven textile permanently encasing the combination of a first foam member and a second foam member of a preferred embodiment of the comfort aid apparatus.

Referring now to FIG. 11, the first foam member 40 and the second foam member 44 of a preferred embodiment of the comfort aid apparatus 20 are permanently encased with a textile material 50 made from a blend of sustainable natural fiber woven materials. In the preferred embodiment, the sustainable natural fiber woven materials are made from, or are a blend of, hemp and organic cotton fibers, although it should be readily understood by those skilled in the art that the textile material 50 may be made from, either individually or in combination cotton, cotton sateen, wool, modal, lyocell, jute, ramie, silk, denim, leather, fur, acetate, chiffon, acrylic, organiza, lastex, nylon, velvet, polyester, taffeta, rayon, Hempcel, bamboo, corn, hemp blends, recycled hemp, recycled cotton, recycled poly, flax, linen, soy georgette, viscose, grey, polypropylene, satin, filter carbon, vinyl plain, blended PFTE, crewel, stretch, knit, reflective, quilted polyethylene, narrow laminated, or the like, without departing from the scope and spirit of the invention. The textile material 50 forms an encasement cover which is permanently affixed around the first foam member 40 and the second foam member 44 and is not removable by the user. In the preferred embodiment, the textile material 50 is sewn around the perimeters of the first foam member 40 and the second foam member 44 using a merrow style and safety stitch 52, although it should be readily understood by those skilled in the art that alternatively the merrow style and safety stitch 52 may be replaced by one or more of a variety of known closures, such as glue, sewing, stitching, or the like, without departing from the scope and spirit of the invention.

Figure 12:
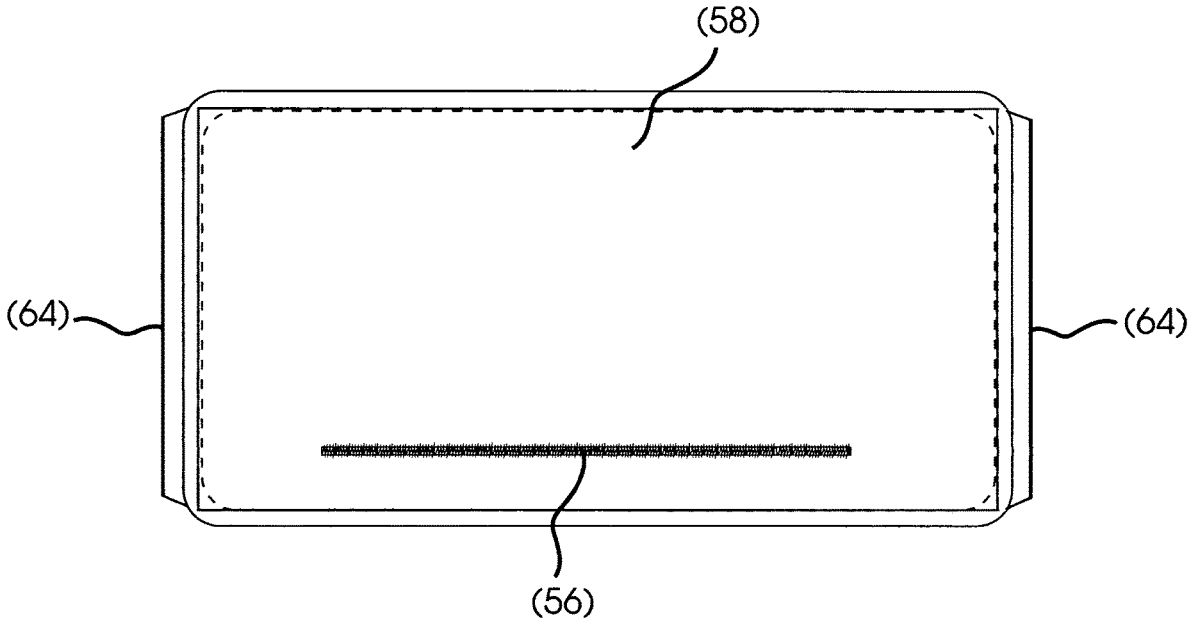
FIG. 12 is a top view of a removable outer textile zipper cover made of sustainable natural fiber woven material illustrating how it fits over the encased first foam member and a second foam member of a preferred embodiment of the comfort aid apparatus.

Referring now to FIG. 12, a removable outer textile zipper cover 58 of a preferred embodiment of the comfort aid apparatus 20 is shown. In the preferred embodiment, the removable outer textile zipper cover 58 is made from sustainable natural fiber woven materials from, or are a blend of, hemp and organic cotton fibers, although it should be readily understood by those skilled in the art that the removable outer textile zipper cover 58 may be made from, either individually or in combination cotton, cotton sateen, wool, modal, lyocell, jute, ramie, silk, denim, leather, fur, acetate, chiffon, acrylic, organiza, lastex, nylon, velvet, polyester, taffeta, rayon, Hempcel, bamboo, corn, hemp blends, recycled hemp, recycled cotton, recycled poly, flax, linen, soy georgette, viscose, grey, polypropylene, satin, filter carbon, vinyl plain, blended PFTE, crewel, stretch, knit, reflective, quilted polyethylene, narrow laminated, or the like, without departing from the scope and spirit of the invention. The removable outer textile zipper cover 58 is sized to cover the permanently-encased first foam member 40 and the second foam member 44. In the preferred embodiment, the removable outer textile zipper cover 58 is approximately 25 inches by approximately 73 inches with an approximate 2-inch seam allowance 64. In the preferred embodiment, the removable outer textile zipper cover 58 will have a zipper 56 which is approximately 60 inches in length disposed proximate a side of the outer textile zipper cover 58 so that the first foam member 40 and the second foam member 44 can be readily inserted or removed. It should be readily understood by those skilled in the art that alternatively the zipper 56 may be replaced by one or more of a variety of known fasteners, such as buttons, snaps, laced string, rope, buckles, hook & eye, hook-and-loop, Velcro, tuck and push lock, turn and twist lock, magnetics, clips, straps, clasps, brackets, loops, threaded fasteners, or the like, without departing from the scope and spirit of the invention.

Figure 13:
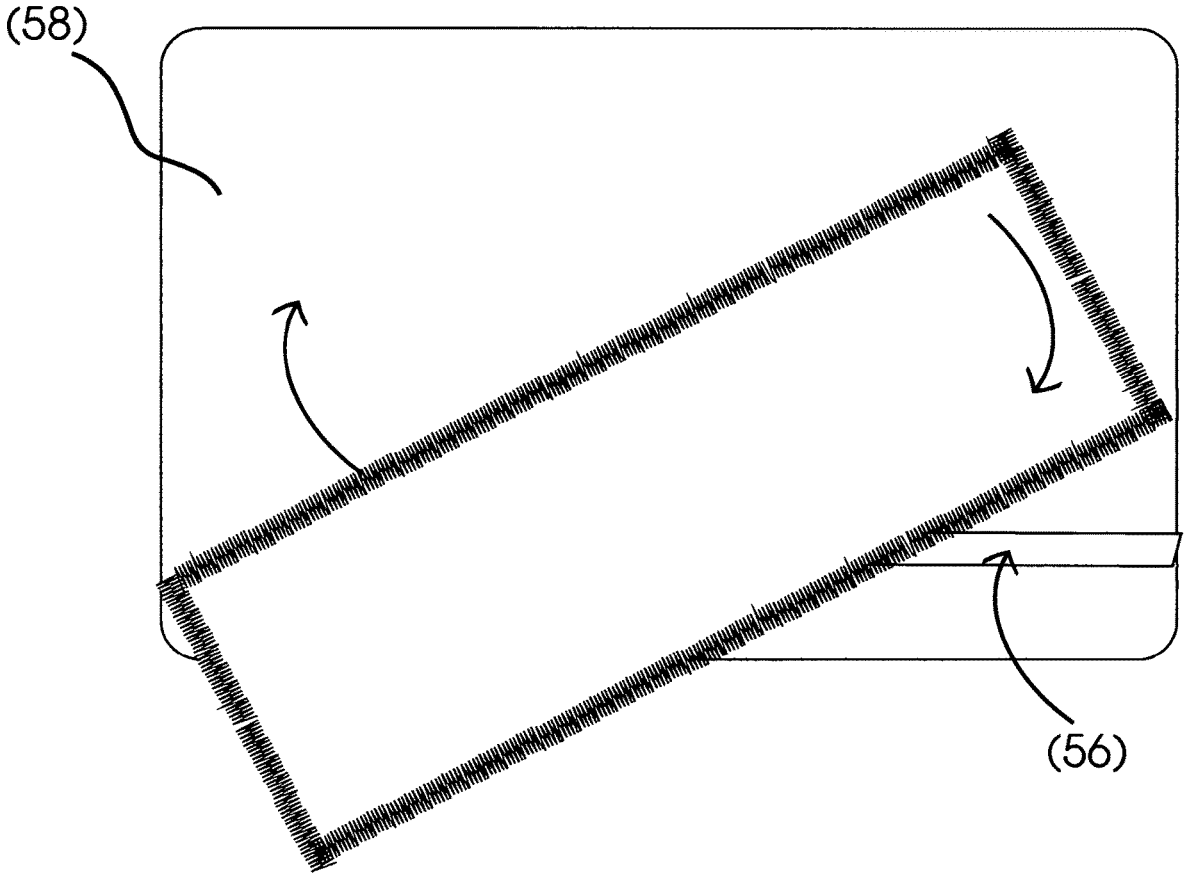
FIG. 13 is a top view of illustrating how the encased first foam member and a second foam member are inserted into a removable outer textile zipper cover of a preferred embodiment of the comfort aid apparatus.

Referring now to FIG. 13, an illustration of how the encased first foam member 40 and the second foam member 44 are inserted through the zipper 56 of the removable outer textile zipper cover 58.

In use, the preferred embodiment of the comfort aid apparatus 20 is disposed on the resting/laying area 18 of a couch, as shown in FIGS. 5 & 6.

Figure 14:
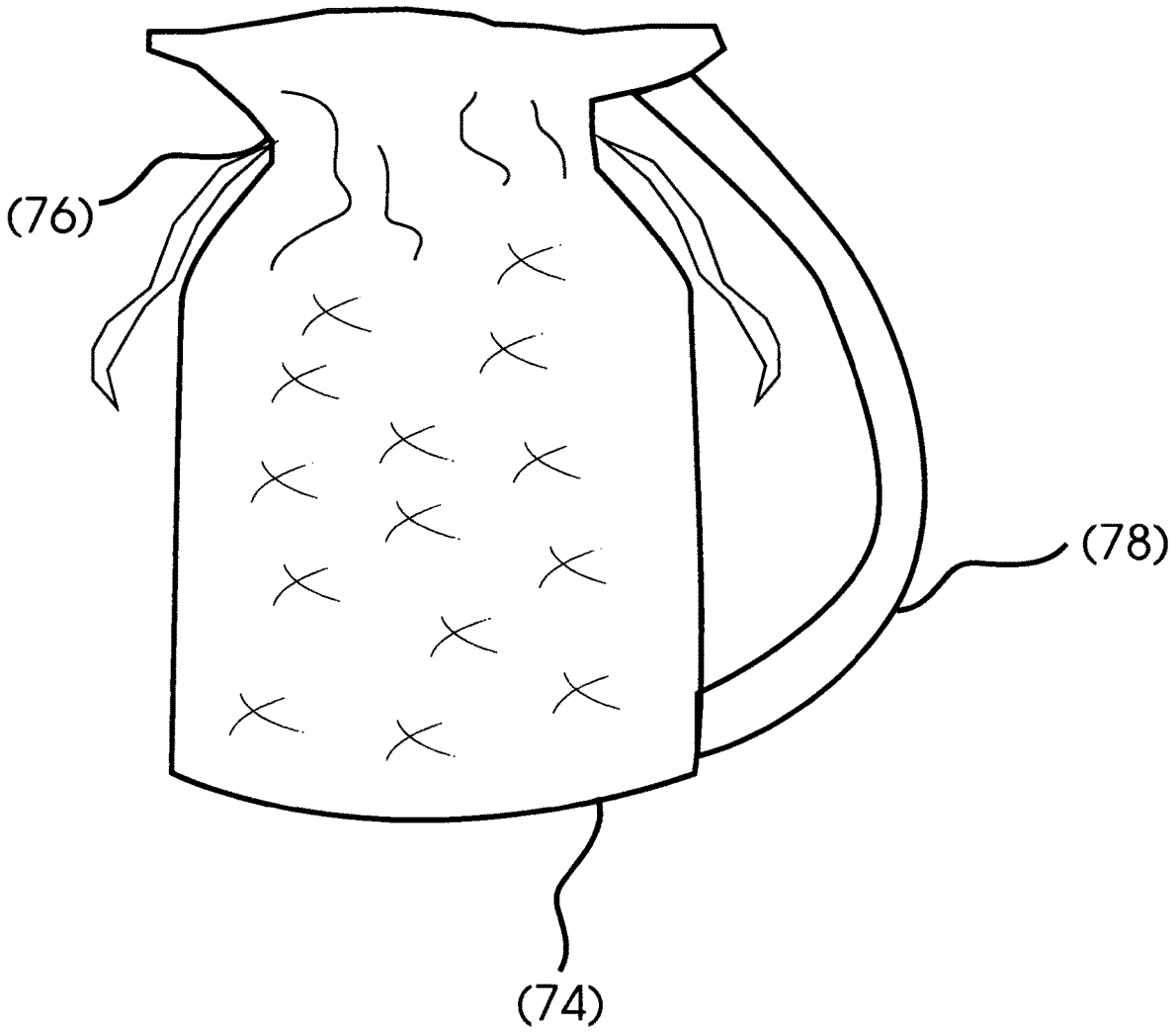
FIG. 14 is a side view of an optional carrying bag for a preferred embodiment of the comfort aid apparatus.

As shown in FIG. 14, to make storage of the comfort aid apparatus 20 convenient, and to make the comfort aid apparatus 20 more portable so that the user can carry the comfort aid apparatus 20 during travels and use the comfort aid device 20 on various couches, a carrying bag 74 with a drawstring 76 and a shoulder strap 78 is optionally provided. The bag 74, drawstring 76 and shoulder strap 78 are made of natural fiber woven burlap/jute, although it should be readily understood by those skilled in the art that the bag 74, drawstring 76 or shoulder strap 78 may be constructed of alternate materials, or the drawstring 76 and/or shoulder strap 78 may be optionally omitted, without departing from the scope and spirit of the invention.

Figure 15:
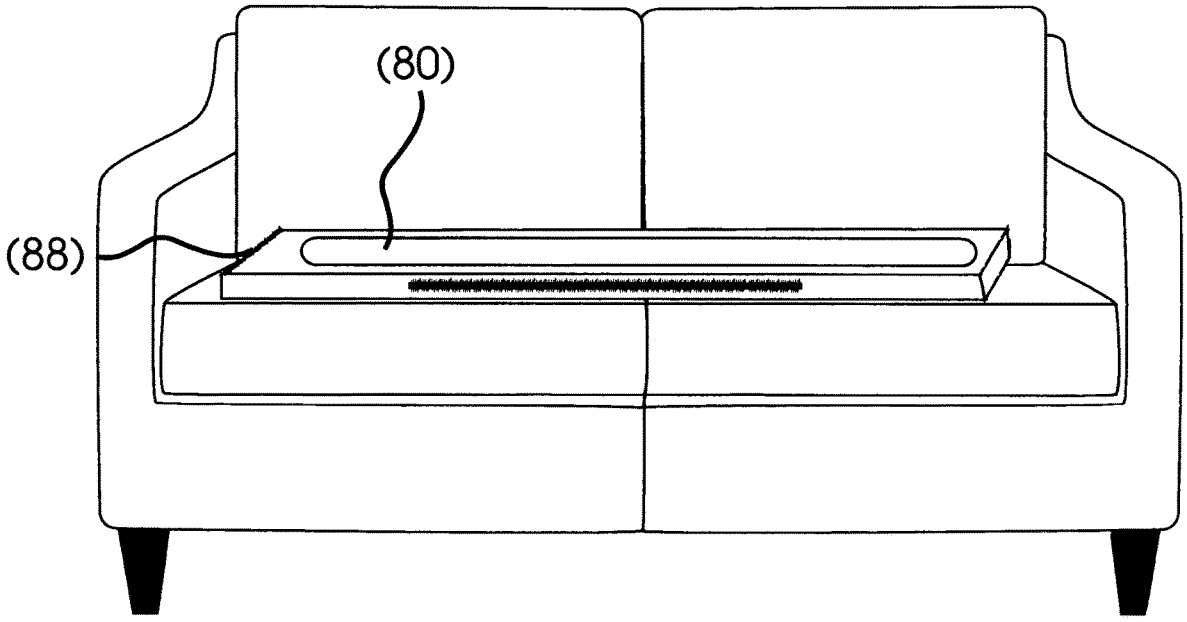
FIG. 15 is a front view of an alternative embodiment of the comfort aid apparatus on a couch.

Referring to FIG. 15, there is shown an alternative embodiment of the comfort aid apparatus 20 on a couch 10. A single foam member 80 having measurements of approximately 24-26 inches by approximately 72-82 inches and a thickness of approximately 1 to 2 inches is substituted for the permanently-encased first foam member 40 and the second foam member 44 of an alternative embodiment of the comfort aid apparatus 20 on a couch 10. In the alterative embodiment, the single foam member 80 is made of, or a blend of, polyurethane, neoprene, EDPM, SBR and neoprene blends, PVC/NBR, silicone, volara (XLPE), microcell urethane foam (poron), soy polyil, synthetic latex or memory foam, poly foam, compressed or shredded polyester, polyester fiberfill, anti-microbial, high density polyurethane, open cell foam, closed cell foam, air, kaizen foam, soft foam, hard foam, memory foam, polyurethane, evion or lux foam, high resilience foam, supreme rebond, gel foam, convoluted foam, reflex foam, down, horse or hog hair. Unlike the preferred embodiment, the single foam member 80 is not permanently encased and is covered with a removable outer woven or non-woven textile zipper cover 88 measuring approximately 24-26 inches by approximately 72-82 inches and is made of, or a blend of, cotton, cotton sateen, wool, modal, lyocell, jute, ramie, silk, denim, leather, fur, acetate, chiffon, acrylic, organiza, lastex, nylon, velvet, rayon, polyester, taffeta, rayon, Hempcel, bamboo, corn, hemp blends, recycled hemp, recycled cotton, recycled poly, flax, linen, soy georgette, viscose, grey, polypropylene, satin, filter carbon, vinyl plain, blended PFTE, crewel, stretch, knit, reflective, quilted polyethylene, narrow laminated, or the like.

Figure 16:
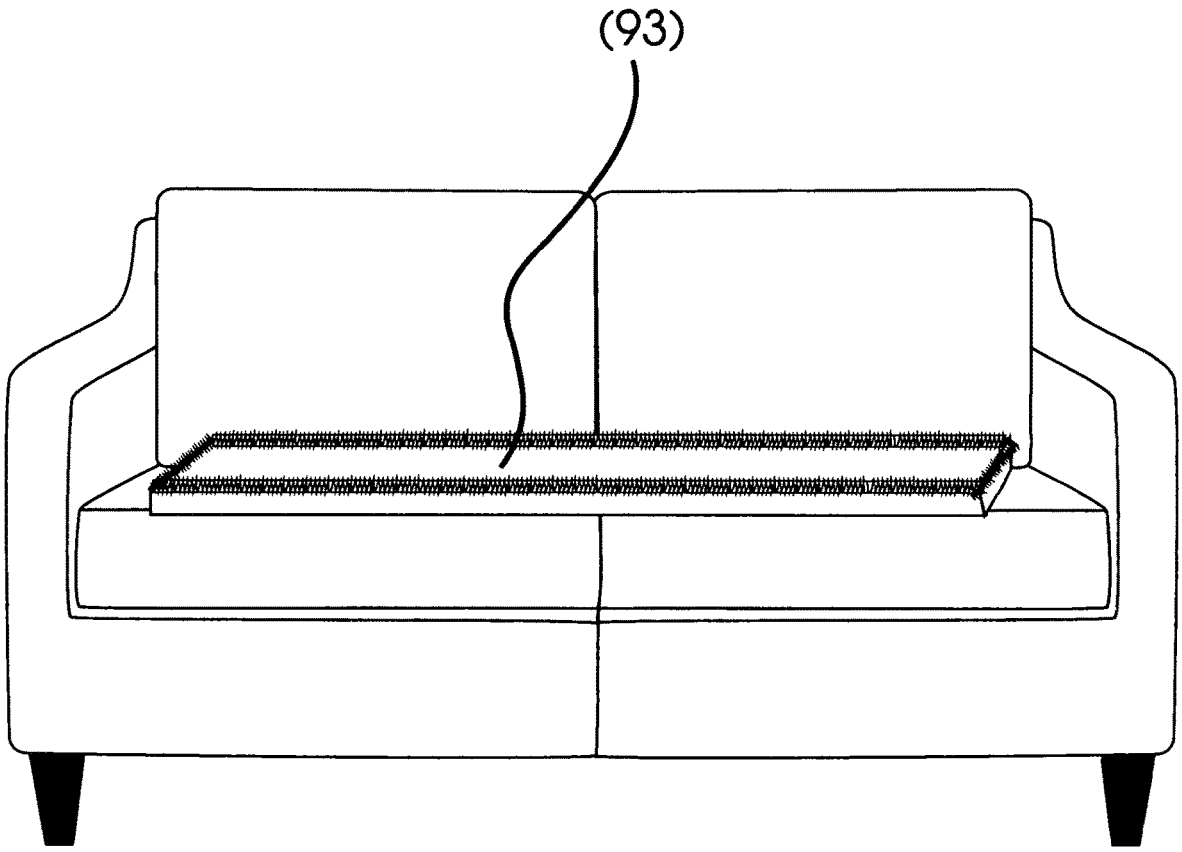
FIG. 16 is a front view of another alternative embodiment of the comfort aid apparatus on a couch.

Referring to FIG. 16, there is shown another alternative embodiment of the comfort aid apparatus 20 on a couch 10. A single foam member 93 having measurements of approximately 24-26 inches by approximately 72-82 inches and a thickness of approximately 1 to 2 inches is substituted for the first foam member 40 and the second foam member 44 of an alternative embodiment. In the alterative embodiment, the single foam member 93 is made of, or a blend of, polyurethane, neoprene, EDPM, SBR and neoprene blends, PVC/NBR, silicone, volara (XLPE), microcell urethane foam (poron), soy polyil, synthetic or natural latex or memory foam, poly foam, compressed or shredded polyester, polyester fiberfill, anti-microbial, high density polyurethane, open cell foam, closed cell foam, air, kaizen foam, soft foam, hard foam, memory foam, polyurethane, evlon or lux foam, high resilience foam, supreme rebond, gel foam, convoluted foam, reflex foam, down, horse or hog hair. This single foam member 93 is permanently encased with a sustainable natural or synthetic, woven or non-woven, textile material composed of, individually or in combination, cotton, cotton sateen, wool, modal, lyocell, jute, ramie, silk, denim, leather, fur, acetate, chiffon, acrylic, organiza, lastex, nylon, velvet, rayon, polyester, taffeta, rayon, Hempcel, bamboo, corn, hemp blends, recycled hemp, recycled cotton, recycled poly, flax, linen, soy georgette, viscose, grey, polypropylene, satin, filter carbon, vinyl plain, blended PFTE, crewel, stretch, knit, reflective, quilted polyethylene, or narrow laminated.

Figure 17:
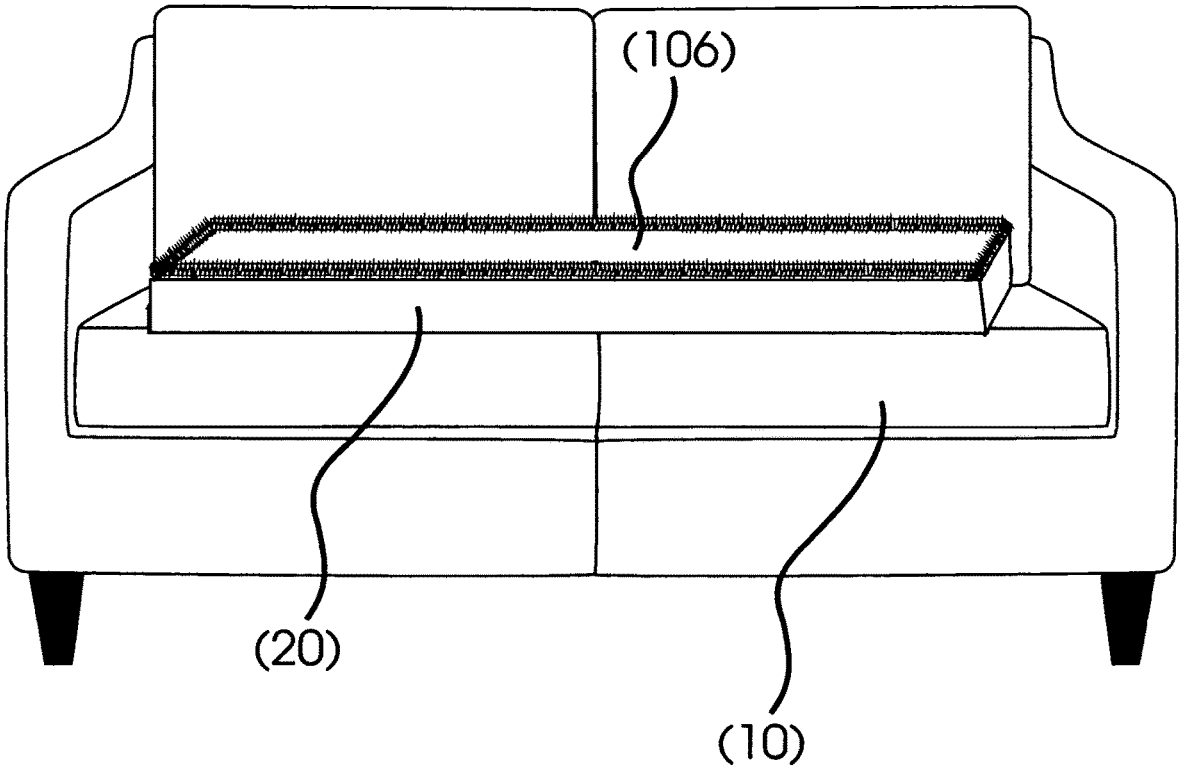
FIG. 17 is a front elevation view of yet another alternative embodiment of the comfort aid apparatus on a couch.

Referring to FIG. 17, there is shown another alternative embodiment of the comfort aid apparatus 20 on a couch 10. In the alternative embodiment, the first foam member 40 and the second foam member 44 of an alternative embodiment are made of, or a blend of, polyurethane, neoprene, EDPM, SBR and neoprene blends, PVC/NBR, silicone, volara (XLPE), microcell urethane foam (poron), soy polyil, synthetic or natural latex or memory foam, poly foam, compressed or shredded polyester, polyester fiberfill, anti-microbial, high density polyurethane, open cell foam, closed cell foam, air, kaizen foam, soft foam, hard foam, memory foam, polyurethane, evlon or lux foam, high resilience foam, supreme rebond, gel foam, convoluted foam, reflex foam, down, horse or hog hair, and the first foam member 40 and the second foam member 44 are permanently encased with a sustainable natural fiber woven or man-made synthetic non-woven material 106 composed of, individually or in combination, composed of, individually or in combination, cotton, cotton sateen, wool, modal, lyocell, jute, ramie, silk, denim, leather, fur, acetate, chiffon, acrylic, organiza, lastex, nylon, velvet, rayon, polyester, taffeta, rayon, Hempcel, bamboo, corn, hemp blends, recycled hemp, recycled cotton, recycled poly, flax, linen, soy georgette, viscose, grey, polypropylene, satin, filter carbon, vinyl plain, blended PFTE, crewel, stretch, knit, reflective, quilted polyethylene, or narrow laminated. The alternative embodiment of the comfort aid apparatus 20 does not include the outer removable zipper cover 58 of a preferred embodiment.

Figure 18:
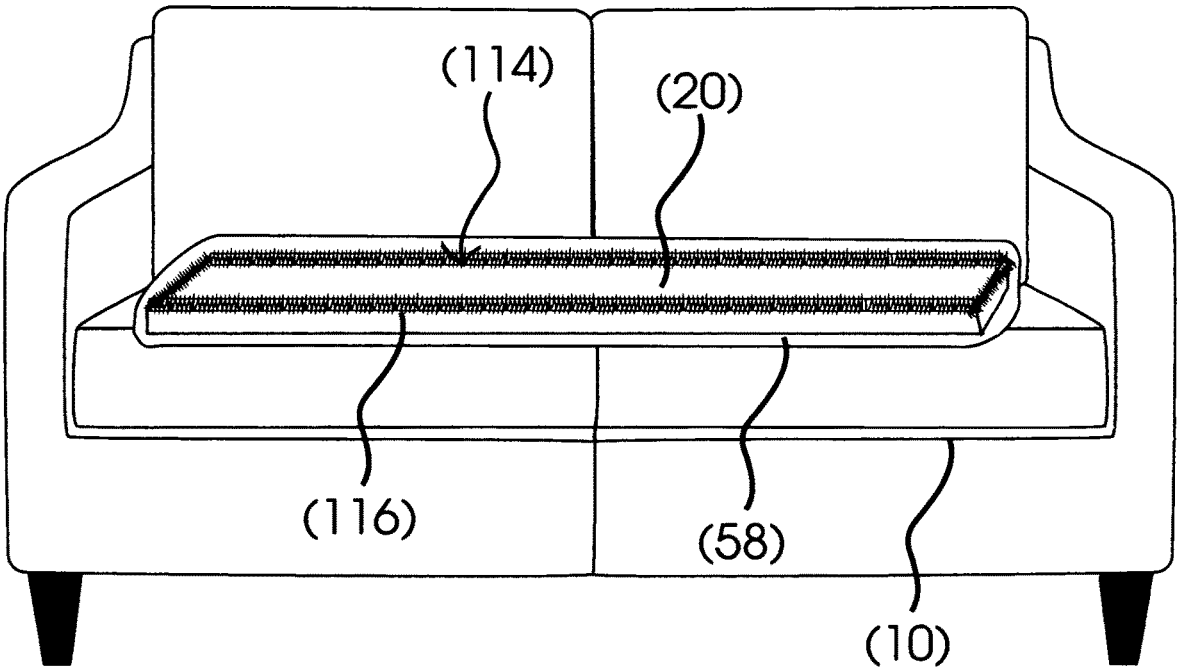
FIG. 18 is a front elevation view of still another alternative embodiment of the comfort aid apparatus on a couch.

Referring to FIG. 18, there is shown another alternative embodiment of the comfort aid apparatus 20 on a couch 10. A single foam member 116 having measurements of approximately 24-26 inches by approximately 72-82 inches and a thickness of approximately 1 to 2 inches is substituted for the first foam member 40 and the second foam member 44 of a preferred embodiment. In the alternative embodiment, the single foam member 116 is made of, or a blend of, polyurethane, neoprene, EDPM, SBR and neoprene blends, PVC/NBR, silicone, volara (XLPE), microcell urethane foam (poron), soy polyil, synthetic latex or memory foam, poly foam, compressed or shredded polyester, polyester fiberfill, anti-microbial, high density polyurethane, open cell foam, closed cell foam, air, kaizen foam, soft foam, hard foam, memory foam, polyurethane, evlon or lux foam, high resilience foam, supreme rebond, gel foam, convoluted foam, reflex foam, down, horse or hog hair. This single foam member 116 is covered with a water-resistant or waterproof material 114 permanently affixed around the single foam member 116. The water-resistant or waterproof material 114 is made of, or a blend of, natural or synthetic fabrics which have a laminated coating or fungistatic treatment, such as latex or rubber, Gore-Tex, vinyl, polyvinyl chloride (PVC), polyurethane (PU), silicone elastomer, PUL, fluoropolymer fabrics, ripstop fabric, laminated cotton, ProCare (25% polyester and 75% vinyl), oil cloth or wax. Treatment of the fabric could be during manufacture or of completed products after manufacture, for instance by a waterproofing spray. This alternative embodiment also includes an outer removable zipper cover 58 which is also made from the waterproof or water-resistant material 114. Treatment of the outer removable zipper cover 58 could be during manufacture or of completed products after manufacture, for instance by a waterproofing spray.

Figure 19:
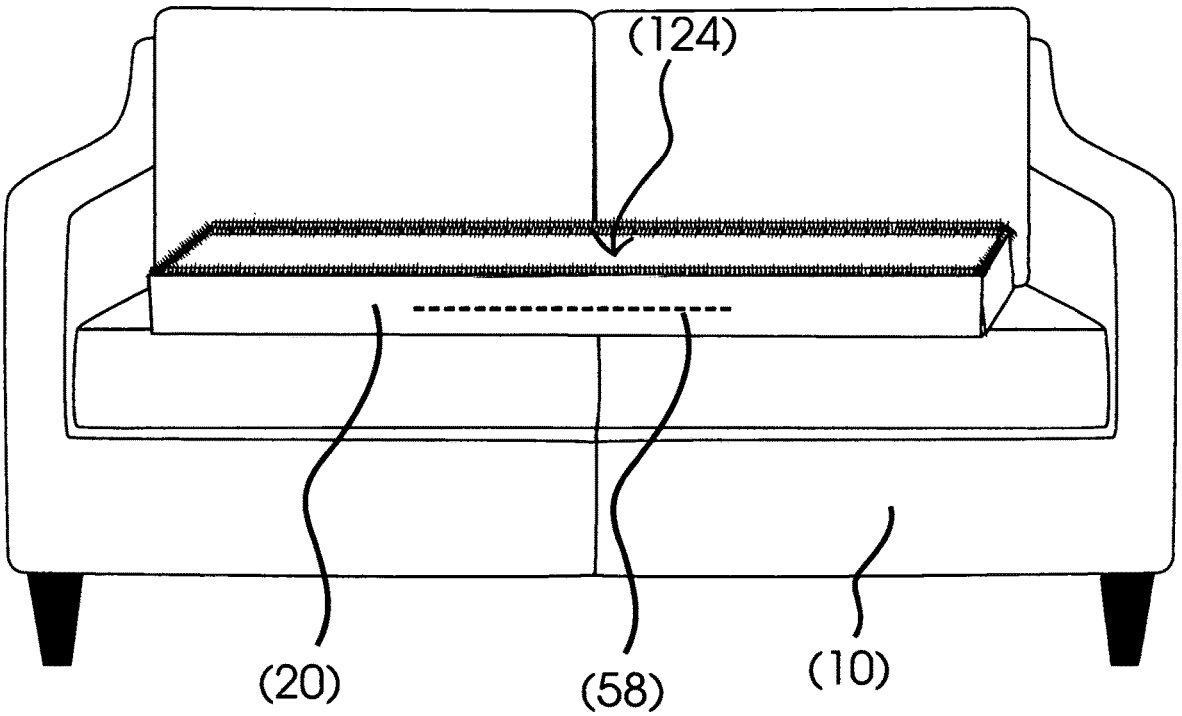
FIG. 19 is a front elevation view of another alternative embodiment of the comfort aid apparatus on a couch.

Referring to FIG. 19, there is shown another alternative embodiment of the comfort aid apparatus 20 on a couch 10. In the alternative embodiment, the first foam member 40 and the second foam member 44 are made of, or a blend of, polyurethane, neoprene, EDPM, SBR and neoprene blends, PVC/NBR, silicone, volara (XLPE), microcell urethane foam (poron), soy polyil, synthetic latex or memory foam, poly foam, compressed or shredded polyester, polyester fiberfill, anti-microbial, high density polyurethane, open cell foam, closed cell foam, air, kaizen foam, soft foam, hard foam, memory foam, polyurethane, evion or lux foam, high resilience foam, supreme rebond, gel foam, convoluted foam, reflex foam, down, horse or hog hair, and the first foam member 40 and the second foam member 44 are permanently encased with a water-resistant or waterproof material 124. The water-resistant or waterproof material 124 is made of, or a blend of, natural or synthetic fabrics which have a laminated coating or fungistatic treatment, such as latex or rubber, Gore-Tex, vinyl, polyvinyl chloride (PVC), polyurethane (PU), silicone elastomer, PUL, fluoropolymer fabrics, ripstop fabric, laminated cotton, ProCare (25% polyester and 75% vinyl), oil cloth or wax. Treatment of the fabric could be during manufacture or of completed products after manufacture, for instance by a waterproofing spray. This alternative embodiment also includes an outer removable zipper cover 58 which is also made from the waterproof or water-resistant material 124. Treatment of the outer removable zipper cover 58 could be during manufacture or of completed products after manufacture, for instance by a waterproofing spray.

Figure 20:
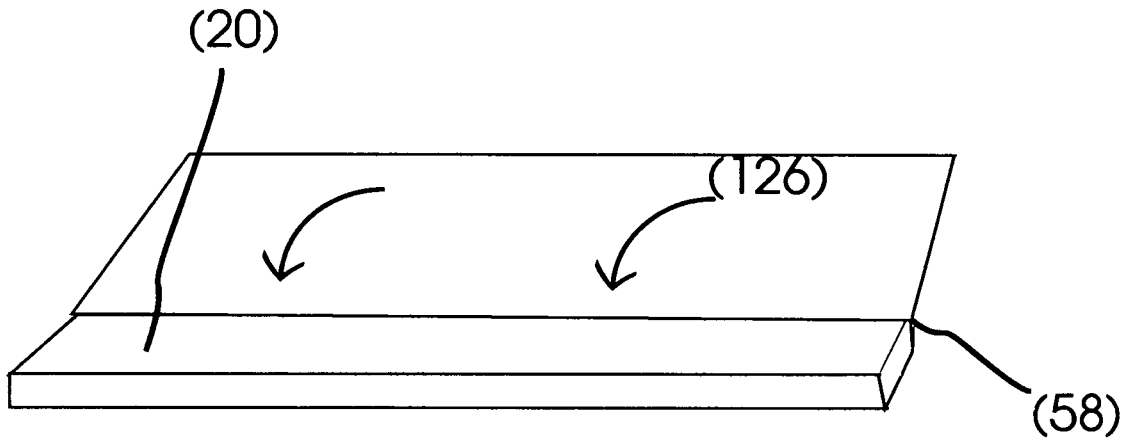
FIG. 20 is a perspective view of an alternative embodiment of the comfort aid apparatus showing an attached top sheet.

Referring to FIG. 20, there is shown another alternative embodiment of the comfort aid apparatus 20. In the alternative embodiment, a man-made synthetic non-woven or sustainable natural woven fiber textile top sheet 126 is attached along at least a portion of one side of the outer removable zipper cover 58 of a preferred embodiment. It should be readily understood by those skilled in the art that the top sheet 126 of the comfort aid apparatus 20 may be attached to the outer removable zipper cover 58 by glue, sewing, stitching, or the like, or integrally formed with the outer removable zipper cover 58, without departing from the scope and spirit of the invention.

Figure 21:
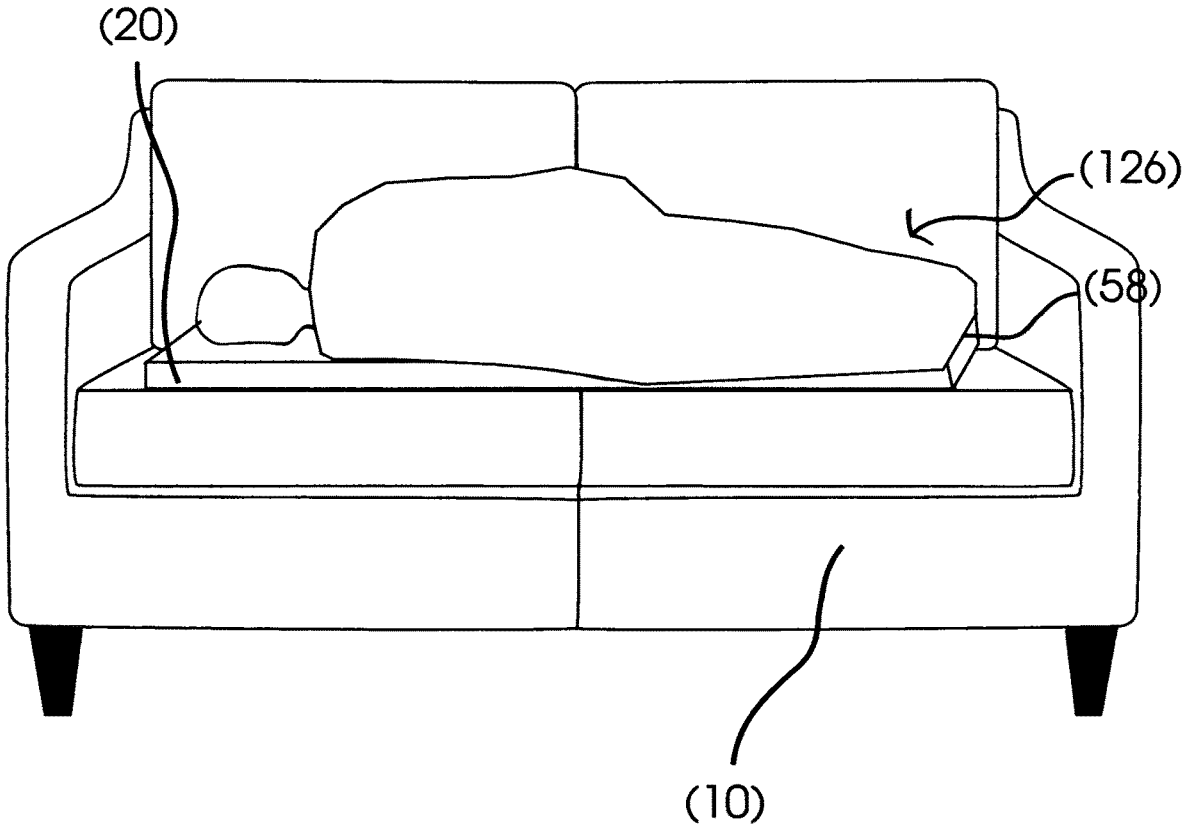
FIG. 21 is a front view of an alternative embodiment of the comfort aid apparatus as shown in FIG. 20, in use, as the user lays on top of the comfort aid apparatus on the couch.

Referring to FIG. 21, in use, as the user lays on top of the comfort aid apparatus 20 on the couch 10, at least a portion of the attached top sheet 126 may be positioned over the user.

Figure 22:
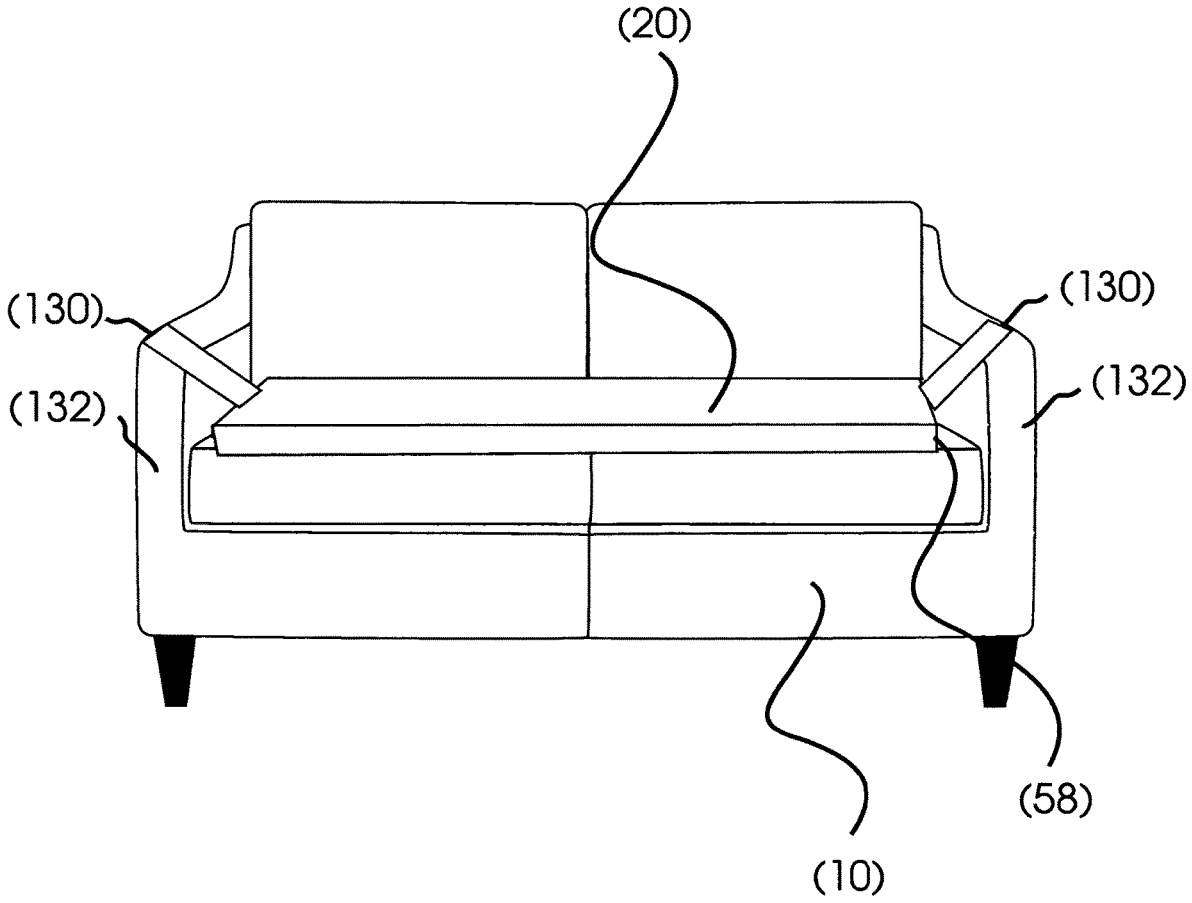
FIG. 22 is a front view of an alternative embodiment of the comfort aid apparatus on a couch illustrating attached Velcro straps which may be secured to the arm rests of a couch.

Referring to FIG. 22, there is shown another alternative embodiment of the comfort aid apparatus 20 on a couch 10. In the alternative embodiment, one or more straps 130 are attached proximate each end of the outer removable zipper cover 58 of a preferred embodiment so that the straps 130 can be secured to both arm rests 132 (or cushions) of a couch so that the comfort aid apparatus 20 does not shift or fall off the couch 10 while being used. It should be readily understood by those skilled in the art that the straps 130 of the comfort aid apparatus 20 may be attached to the outer removable zipper cover 58 by glue, sewing, stitching, or the like, or integrally formed with the outer removable zipper cover 58, without departing from the scope and spirit of the invention.

Figure 23:
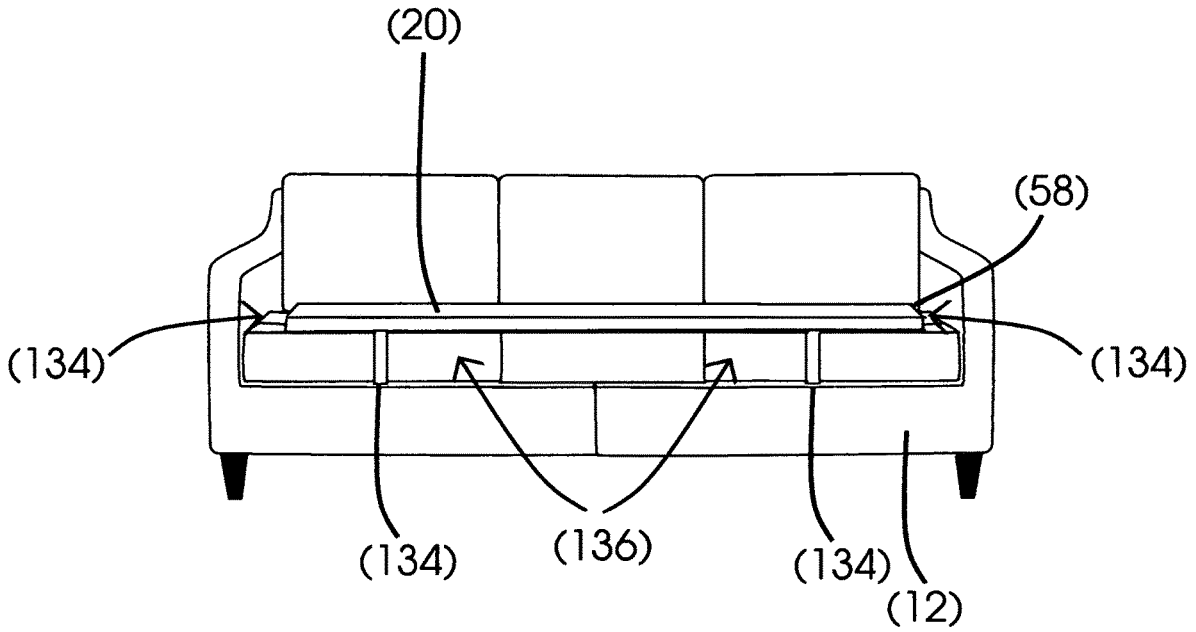
FIG. 23 is a front view of an alternative embodiment of the comfort aid apparatus on a couch illustrating attached straps which may secure the comfort aid apparatus to couch cushions.

Referring to FIG. 23, there is shown another alternative embodiment of the comfort aid apparatus 20 on a couch 12. In the alternative embodiment, Velcro or snap-on straps 134 are attached to the sides of the outer removable zipper cover 58 of a preferred embodiment and can be wrapped around the couch cushions 136 so that the comfort aid apparatus 20 does not shift or fall off the couch while being used.

Figure 24:
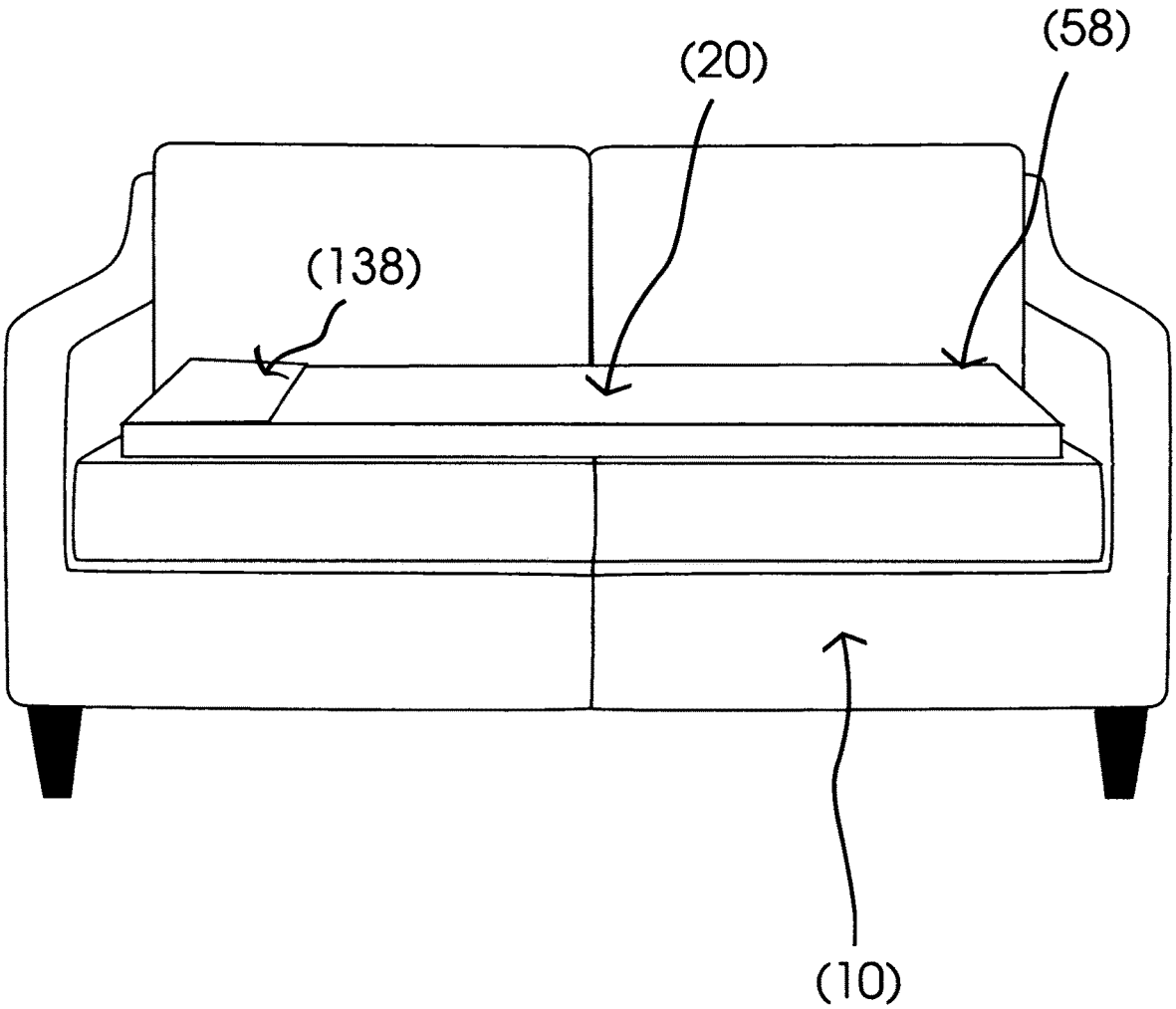
FIG. 24 is a front view of an alternative embodiment of the comfort aid apparatus on a couch illustrating an attached pillow sleeve cover.

Referring to FIG. 24, there is shown another alternative embodiment of the comfort aid apparatus 20 on a couch 10. In the alternative embodiment, a generally rectangular pillow sleeve cover 138 is attached proximate at the end of the removable outer textile zipper cover 58. The pillow sleeve cover 138 allows the user to insert a pillow (not shown) from either opposite end of the pillow sleeve cover 138.

Figure 25:
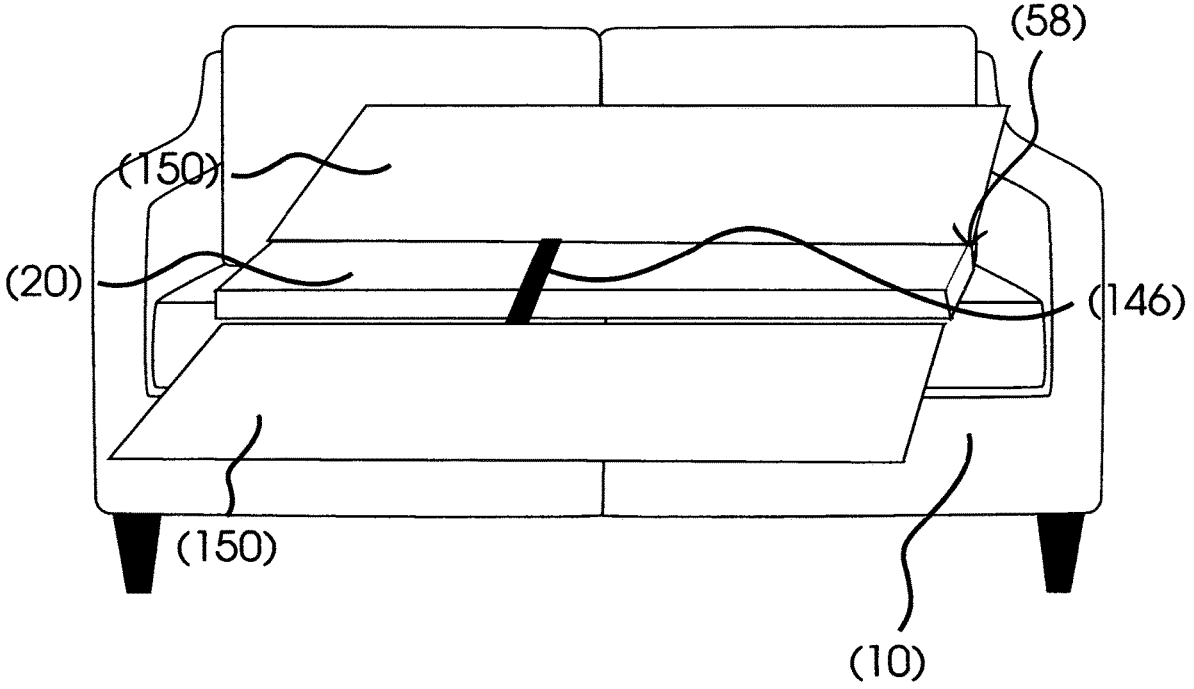
FIG. 25 is a front view of an alternative embodiment of the comfort aid apparatus on a couch illustrating a strap which is attached to a sustainable natural fiber woven wrap sheet.

Referring to FIG. 25, there is shown another alternative embodiment of the comfort aid apparatus 20 on a couch 10. In the alternative embodiment, a strap 146 is attached to a natural fiber woven wrap sheet 150. A preferred embodiment of the comfort aid apparatus 20 is laid between strap 146 and the top of the sustainable natural fiber woven wrap sheet 150. When the user is laying on top of the comfort aid apparatus 20, the user is then able to fold one side of the wrap sheet 150 on top of the user and then overlay the opposite end of the wrap sheet 150 on top of the user.

Hence, while the invention has been described in connection with a preferred embodiment and alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum proportions for the elements of the invention, and variations in size, materials, shape, form, function and manner of operation, assembly and use, are deemed readily apparent and obvious to one skilled in the art, and all equivalent relationships described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact method, construction and operation shown and described, and accordingly, all suitable modifications and equivalents may be resorted to, falling within the scope of the invention.

What is claimed:

1. A comfort aid apparatus for use on a couch, the couch having a resting/laying area defined generally between ends of the couch and generally overlaying couch cushions, the comfort aid apparatus comprising, in combination:

a generally rectangular block element sized to substantially overlay the resting/laying area of the couch, or at least that portion of a couch generally necessary to contain a user thereon, said generally rectangular block element having a generally rectangular block first foam member and a generally rectangular block second foam member, said first foam member being constructed of natural latex extracted from rubber trees and said second foam member being constructed of a combination of coconut fiber with a bonding agent of latex, said first foam member and said second foam member being stacked on each other during construction of the comfort aid apparatus, said first foam member and said second foam member are permanently encased with a textile material made from a blend of sustainable natural fiber woven materials, said sustainable natural fiber woven materials are made from, or are a blend of, hemp and organic cotton fibers;

a removable outer textile zipper cover, said removable outer textile zipper cover being made from sustainable natural fiber woven materials from, or are a blend of, hemp and organic cotton fibers, said removable outer textile zipper cover being sized to cover the permanently encased said first foam member and said second foam member; and a strap attached to a natural fiber woven wrap sheet, comfort aid apparatus laid between said strap and said natural fiber woven wrap sheet, whereby when a user is laying on top of the comfort aid apparatus, the user is then able to fold one side of said wrap sheet on top of the user and then overlay the opposite end of said wrap sheet on top of the user.

2. A comfort aid apparatus for use on a couch, the couch having a resting/laying area defined generally between ends of the couch and generally overlaying couch cushions, the comfort aid apparatus comprising, in combination: a generally rectangular block element sized to substantially overlay the resting/laying area of the couch, or at least that portion of a couch generally necessary to contain a user thereon, said generally rectangular block element having a generally rectangular block first foam member and a generally rectangular block second foam member, said first foam member being constructed of natural latex extracted from rubber trees and said second foam member being constructed of a combination of coconut fiber with a bonding agent of latex, said first foam member and said second foam member being stacked on each other during construction of the comfort aid apparatus, wherein said first foam member has a first foam member density and firmness and said second member has a second foam member density, wherein said second foam member density and firmness is higher than the first foam member density and firmness wherein said first foam member and said second foam member are permanently encased with a textile material made from a blend of sustainable natural fiber woven materials, said sustainable natural fiber woven materials are made from, or are a blend of, hemp and organic cotton fibers; a removable outer textile zipper cover, said removable outer textile zipper cover being made from sustainable natural fiber woven materials from, or are a blend of, hemp and organic cotton fibers, said removable outer textile zipper cover being sized to cover the permanently encased said first foam member and said second foam member; and a strap attached to a natural fiber woven wrap sheet, comfort aid apparatus laid between said strap and said natural fiber woven wrap sheet, whereby when a user is laying on top of the comfort aid apparatus, the user is then able to fold one side of said wrap sheet on top of the user and then overlay the opposite end of said wrap sheet on top of the user.

* * * * *